United States Patent [19]

Muromoto, deceased

[11] 4,176,450

[45] Dec. 4, 1979

[54] CUTTER MAINLY FOR CUTTING SYNTHETIC RESIN ARTICLES

[75] Inventor: Wasaburo Muromoto, deceased, late of Neyagawa, Japan, by Osamu Muromoto, executor

[73] Assignee: Muromoto Iron Works Co., Ltd., Neyagawa, Japan

[21] Appl. No.: 872,238

[22] Filed: Jan. 25, 1978

[30] Foreign Application Priority Data

Jan. 25, 1977 [JP] Japan ..... 52-7839[U]

[51] Int. Cl.[2] ..... B26B 13/00

[52] U.S. Cl. ..... 30/92; 30/251

[58] Field of Search ..... 30/92, 250, 249, 252, 30/251, 192, 258

[56] References Cited

U.S. PATENT DOCUMENTS

| | | | |
|---|---|---|---|
| 2,280,159 | 4/1942 | Neal | 30/251 |
| 3,210,844 | 10/1965 | Tontscheff | 30/92 |
| 4,094,064 | 6/1978 | Nishikawa et al. | 30/92 |

*Primary Examiner*—Robert L. Spruill
*Assistant Examiner*—J. T. Zatarga
*Attorney, Agent, or Firm*—Wenderoth, Lind & Ponack

[57] ABSTRACT

A cutter comprising a main body including a holder handle and a holder portion, an operating handle pivoted to the holder portion and opposed to the holder handle, a cutting blade turnably mounted on the holder portion, and a ratchet mechanism for converting the opening and closing movement of the handles to the turn of the cutting blade. The holder portion adapted to support a workpiece is disposed across the path of turning movement of the cutting blade in opposed relation to its cutting edge.

17 Claims, 11 Drawing Figures

CUTTER MAINLY FOR CUTTING SYNTHETIC RESIN ARTICLES

BACKGROUND OF THE INVENTION

The present invention relates to a cutter mainly for synthetic resin workpieces, and more particularly to a cutter for cutting synthetic resin articles such as polyvinyl chloride or like synthetic resin pipes and tubes for water supply systems, power cables and telephone cables.

Synthetic resin articles are cut usually by the following methods.

1. With use of saw

With use of a saw, workpieces are difficult to cut quickly and easily, while the saw leaves traces of saw teeth on the cut end, creating a rugged face which must be smoothened. The cutting operation therefore requires a cumbersome procedure.

2. With use of scissors

According to this method, workpieces are cut in a snipping manner with a pair of cutting blades which are movable past one another. Since the opening and closing movement of the handles is converted directly to the opening and closing of the blades, the cutting operation requires a great force and it is impossible to use the scissors only with one hand. The cutting blades, which will not bite into the workpiece easily, must be given an excess force when starting to cut the workpiece, possibly cracking or otherwise deforming the workpiece at or near the cutting portion. Additionally the cutting blades are likely to leave a stepped portion on the cut end face when deviating from each other in the course of cutting, thus necessitating a finishing procedure to smoothen the cut end.

3. With use of cutter of the single blade type

FIG. 11 shows a cutter of this type. The opening and closing movement of handles 51 and 52 is converted to the turn of a cutting blade 53 about a pivot 54 to cut a workpiece supported on a holder portion 51'. When the handles are opened and closed, an engaging projection 56 on the distal end of an operating rod 55 engages in one of cutouts 58', 58'' and 58''' successively in the order mentioned which cutouts are formed in a recess 57 in the base portion 53' of the cutting blade 53, turning the cutting blade 53 about the pivot 54 in the direction of the arrow shown. With this construction, therefore, the force required for cutting (i.e. gripping force to close the handles 51 and 52) progressively increases as the distance between the pivot 54 and the projection 56 decreases, presenting difficulty in opening and closing the handles by one hand.

SUMMARY OF THE INVENTION

An object of this invention is to provide a cutter mainly for synthetic resin workpieces by which the workpiece can be cut with ease by opening and closing a holder handle and an operating handle with one hand.

Another object of this invention is to provide a cutter by which the workpiece can be cut at right angles to its axis free of any displacement during cutting to give a smooth cut end.

Still another object of this invention is to provide a cutter for cutting workpieces without causing deformation of or damage to the workpiece at or near the cut portion.

Basically, the cutter of this invention comprises a main body including a base portion serving as a holder handle and a front half portion serving as a holder portion having at least one recess for holding workpieces, an operating handle mounted by a pivot on the holder portion and movable toward and away from the holder handle in opposed relation thereto, a cutting blade turnably mounted by a support pin on the holder portion and having a cutting edge in opposed relation to the recess, the cutting blade being formed with ratchet teeth on one side of the support pin opposed to the cutting edge, a pawl pivotally mounted by a pivot pin on the operating handle and engageable with one of the ratchet teeth to provide a ratchet mechanism, and a spring having one end secured to the operating handle and the other end attached to the base end of the pawl for biasing the pawl into engagement with the ratchet toothed portion at all times.

DESCRIPTION OF THE PREFERRED EMBODIMENTS

Figure 1:
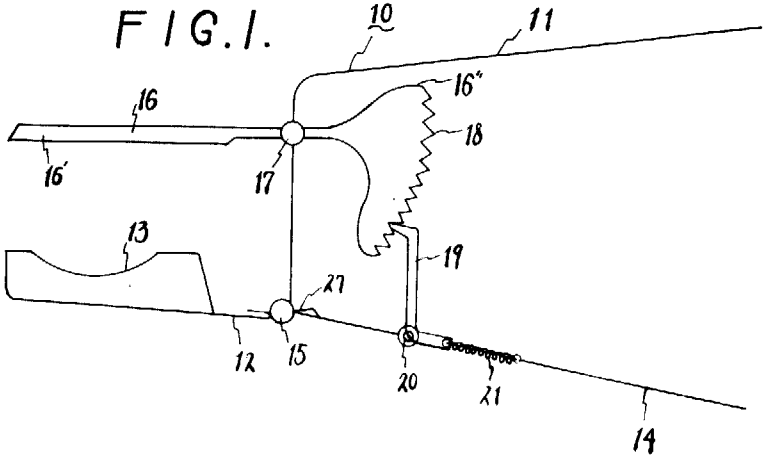
FIG. 1 is a diagram showing the main mechanism of a cutter according to this invention.

This invention will be described below in greater detail with reference to the accompanying drawings. FIG. 1 shows a main body 10 including a base portion serving as a holder handle 11 and a front half portion serving as a holder portion 12 extending downwardly from the handle 11 approximately at a right angle thereto. The front end of the holder portion 12 extends from the main part thereof at a right angle thereto and has a recess 13 for holding a workpiece.

Arranged in opposed relation to the holder handle 11 is a straight operating handle 14 which is turnably mounted by a pivot 15 on the holder portion 12 of the main body 10. The operating handle 14 is biased away from the holder handle 11 at all times by a spring 27 on the pivot 15.

A cutting blade 16 is pivotally mounted on a support pin 17 approximately at the junction between the holder portion 12 of the main body 10 and its handle 11. The cutting edge 16' of the blade 16 is opposed to the recess 13 of the holder portion 12. The base portion 16'' of the cutting blade 16 is formed, along the outer periphery of its right end, with ratchet teeth 18 which are arranged along a circular arc centered about the support pin 17. A pawl 19 in engagement with the toothed portion 18 to provide a ratched mechanism has an obliquely upwardly extending forward end and is pivoted at its base end by a pin 20 to the operating handle 14. The pawl 19 is biased into engagement with one of the ratchet teeth 18 by a spring 21 at all times.

Figure 2:
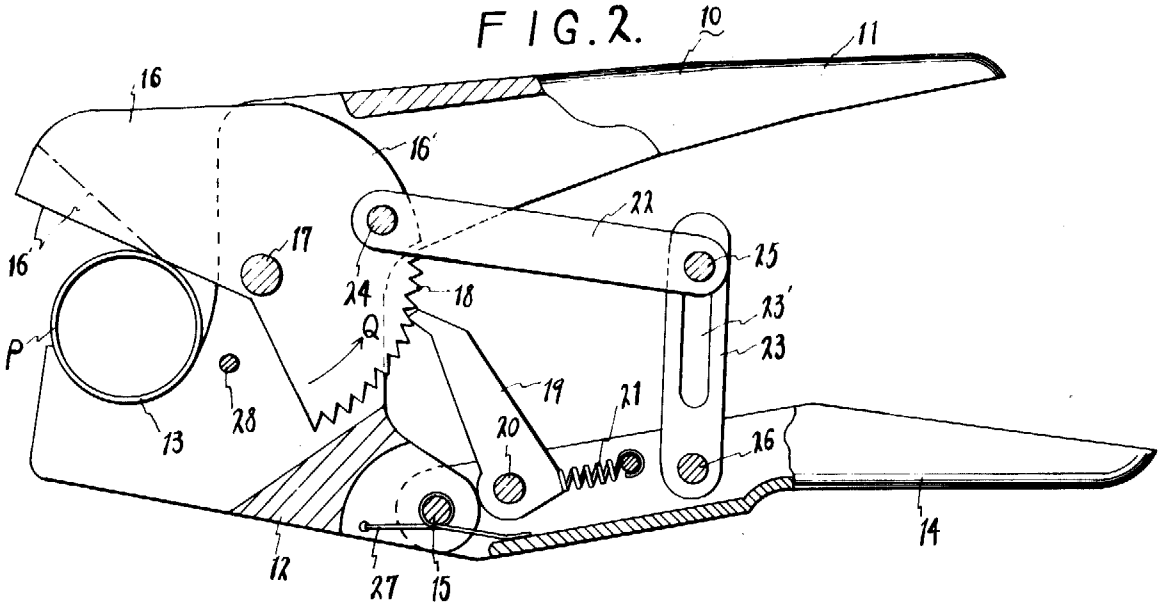
FIG. 2 is a front view partly broken away and showing a cutter of specific construction embodying this invention immediately before the cutter starts to cut a workpiece.
Figure 3:
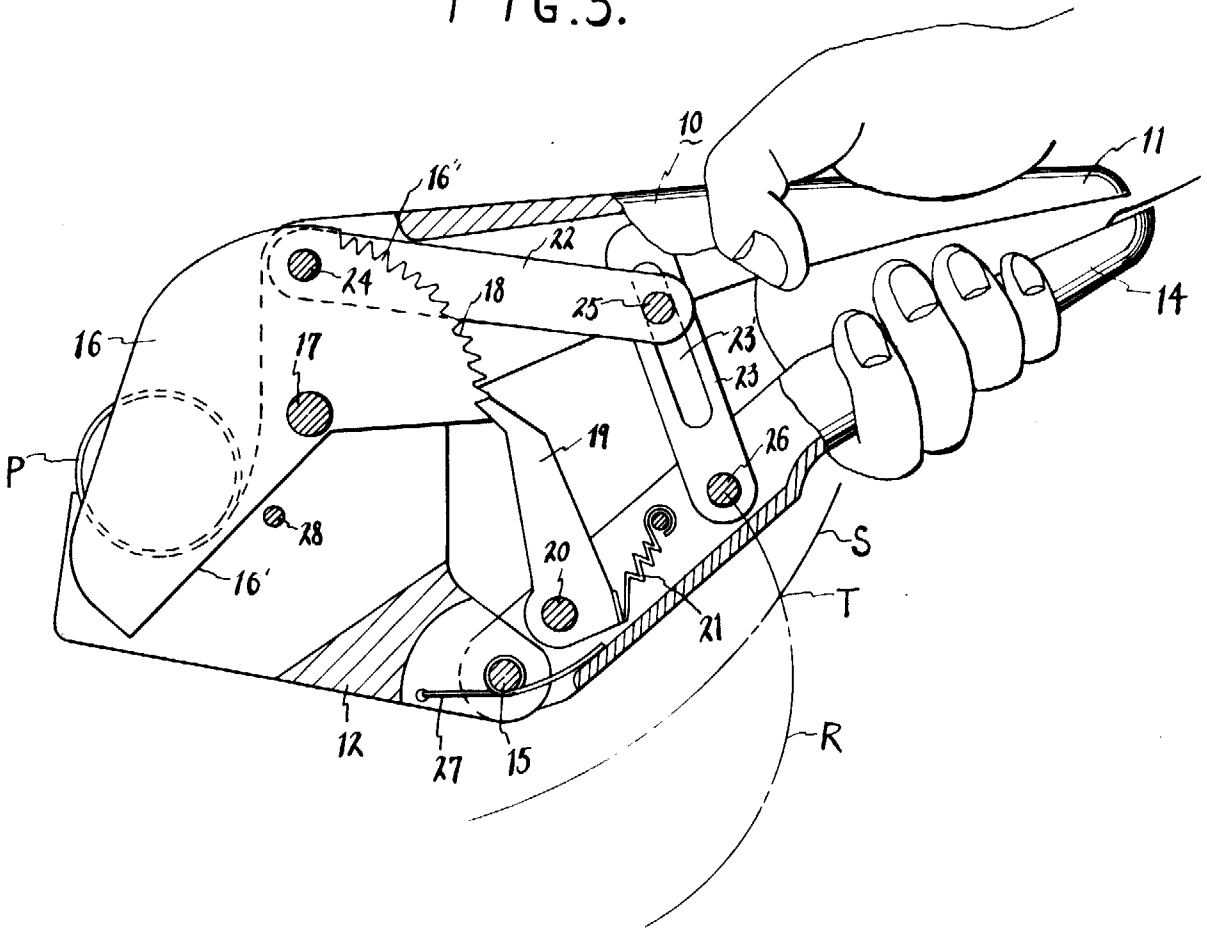
FIG. 3 is a front view partly broken away and showing the same on completion of the cutting operation.
Figure 4:
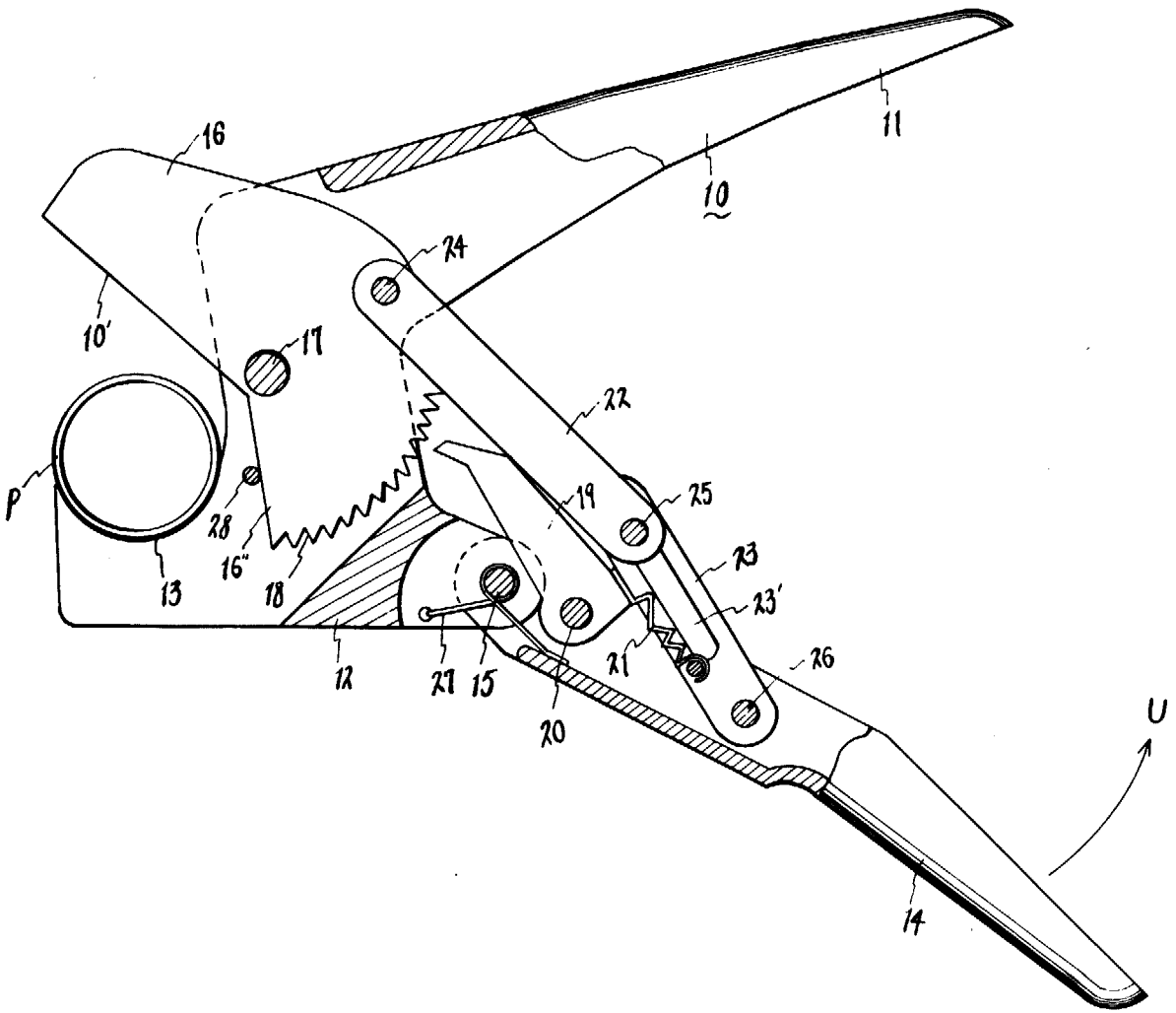
FIG. 4 is a front view partly broken away and showing the same with the holder handle thereof and its operating handle in an open position.

The holder handle 11 and the operating handle 14, when gripped by the hand, cause the pawl 19 to force the toothed portion 18 upward in engagement with a ratchet tooth thereof, bringing the cutting edge 16 toward the holder portion 13. When the handles 11 and 14 are moved away from each other, the tip of the pawl 19 descends the toothed portion 18 and comes into engagement with the adjacent ratchet tooth while being pressed thereagainst by the spring 21 at all times. When the handles 11 and 14 are gripped again, the cutting edge 16 is brought closer to the holding portion 13 in the same manner as above. When this operation is repeated, the cutting edge 16 eventually intersects the recessed portion 13, thereby cutting a workpiece placed on the recessed portion. On completion of the cutting operation, the pawl 19 is disengaged from the toothed portion 18 by hand, and the cutting blade 16 moved away from the recessed portion 13, whereby the parts are returned to the original position. The arrangement described has the drawback that it requires the troublesome procedure of turning the cutting blade 16 away from the recessed portion 13. FIGS. 2 to 4 show another embodiment with which this drawback has been overcome.

The main body 10 of the embodiment shown in FIG. 2 is composed of coextensive two plates which are integral with each other at the outer side. The main body 10 includes a holder handle 11 and a holder portion 12 extending downward from the handle 11 at a right angle thereto and laterally projecting toward the opposite sides in a substantially T-shaped configuration, the holder portion 12 being integral with the holder handle 11. A support pin 17 is fixed to a suitable portion of the junction between the handle 11 and the holder portion 12.

The cutting blade 16 having a blade 16' at a forward end lower portion thereof is disposed between the two plates of the main body 10 and turnably mounted on the support pin 17. The base portion 16" of the cutting blade 16 is in the form of a circular arc centered about the support pin 17 and has a toothed outer periphery 18.

The left end of the holder portion 12 is formed with a recessed portion 13 of double-plate structure having a circular arc upper face of specified radius. The blade edge 16', when turned, is movable into the space between the two plates of the recessed portion 13.

The holder portion 12 is fixedly provided at its right end with a pivot 15 on which an operating handle 14 of double-plate structure is turnably mounted at its one end. The pivot 15 further carries a spring 27 having one end bearing on the holder portion 12 and the other end in pressing engagement with the bottom of the double-plate handle 14. The spring 27 urges the handles 11 and 14 away from each other.

A pawl 19 has a sharp forward end in engagement with the circular arc toothed portion 18 and a base portion positioned between the two plates of the operating handle 14 and pivotably mounted on a pin 20 fixed to the handle 14 at a suitable position close to the pivot 15.

A spring 21 provided between the two plates of the operating handle 14 has one end secured to the right end of the base portion of the pawl 19 and the other end secured to the operating handle 14 to pull the pawl base portion rightward. Consequently the pawl 19 is so biased as to be retained at a given angle to the handle 14.

A link 22 has one end pivoted by a pin 24 to the base portion 16" of the cutting blade 16 at a position slightly above the upper end of the toothed portion 18 and the other end fixedly carrying a pin 25. The fixed pin 25 is slidably fitted in a slot 23' formed in another link 23 which is pivotably mounted at its base end on a pin 26 extending between the two plates of the operating handle 14. The links 22 and 23 are so dimensioned and positioned as will be described below with reference to FIG. 3 showing the cutter when it has cut a workpiece.

It is assumed that the links 22 and 23 are extended in alignment with each other. In this state, the pin 26 will move about the pin 24 along a circular arc path S. With the turn of the operating handle 14 about the pivot 15, the pin 26 will move along a circular arc path R. The two paths intersect each other at a point T, at which the operating handle 14, when opened, causes the links 22 and 23 to start to turn the cutting blade 16 about the support pin 17 in a clockwise direction. Accordingly the position of the pin 20 and the dimensions and mounting position of the links 22 and 23 relative thereto are so determined that when the operating handle 14 comes to the above-mentioned position, the pawl 19 will be brought out of engagement with the toothed portion 18.

A pin 28 on the holder portion 12 serves as a stopper for limiting the clockwise turn of the cutting blade 16.

The arrangement in which the link 23 is formed with the slot 23' for slidably guiding the end of the link 22 renders the handles 11 and 14 movable free of inteference with the link mechanism when they are brought very close to each other as seen in FIG. 3 in the final stage of the cutting operation.

When the handles 11 and 14 are gripped and repeatedly opened and closed by hand with a workpiece P placed on the recessed portion 13 as seen in FIG. 2, the operating handle 14 causes the pawl 19 to push up the toothed portion 18 in the direction of the arrow Q in FIG. 2, i.e. counterclockwise, by an amount corresponding to one to several teeth every time the handles are opend and closed. This movement forces the cutting blade edge 16' to progressively bite into the workpiece P and eventually cut the workpiece P completely as shown in FIG. 3.

On completion of the cutting operation, the handles 11 and 14 are released from the hand. The pawl 19 disengages from the toothed portion 18 first, freeing the cutting blade 16. The operating handle 14 is thereafter turned further downward about the pivot 15. During this procedure, the link 22 and 23 are aligned when the operating handle 14 has turned to the intersection T between the dot-and dash line R representing the path of movement of the pin 26 about the pivot 15 shown in FIG. 3 and the circular arc dot-and-dash line S centered about the support pin 17 and having a radius corresponding to the combined length of the links 22 and 23 shown in FIG. 3. A further turn of the operating handle 14 turns the cutting blade 16 about the pin 17 in a clockwise direction, bringing the blade 16 into contact with the stopper pin 28 as shown in FIG. 4. For the subsequent cutting operation, the workpiece P is placed on the recessed portion 13, and the operating handle 14 is turned backward in the direction of the arrow U in FIG. 4 with the links 22 and 23 and pawl 19 returned to the original position seen in FIG. 2. The cutter is now ready for cutting.

The cutter described above has the following features and advantages.

The ratchet teeth 18 formed on the base portion outer periphery of the cutting blade 16 are arranged along a circular arc centered about the support pin 17 about which the cutting blade 16 turns, permitting the engagement of the pawl 19 with the toothed portion 18 to take place on the same circular line at all times, with the resulting advantage that the cutting operation can be readily carried out by one hand always with a constant force to close the handles 11 and 14.

The opening and closing movement of the handles is converted by a ratchet mechanism to the turn of the cutting blade 16, thus intermittently turning the cutting blade 16 about the pin 17 through a given angle at a time corresponding to the number of the ratchet teeth advanced every time, when cutting the workpiece. This eliminates the deformation of and damage to the workpiece which otherwise would result from an excess shearing force.

Unlike the arrangement illustrated in FIG. 1, the links 22 and 23 incorporated in the embodiment of FIGS. 2 to 4 render the pawl 19 disengageable from the ratchet tooth 18 and the cutting blade 16 movable away from the recessed portion 13 to the original position, merely by moving the operating handle 14 away from the holder handle 11.

Figure 5:
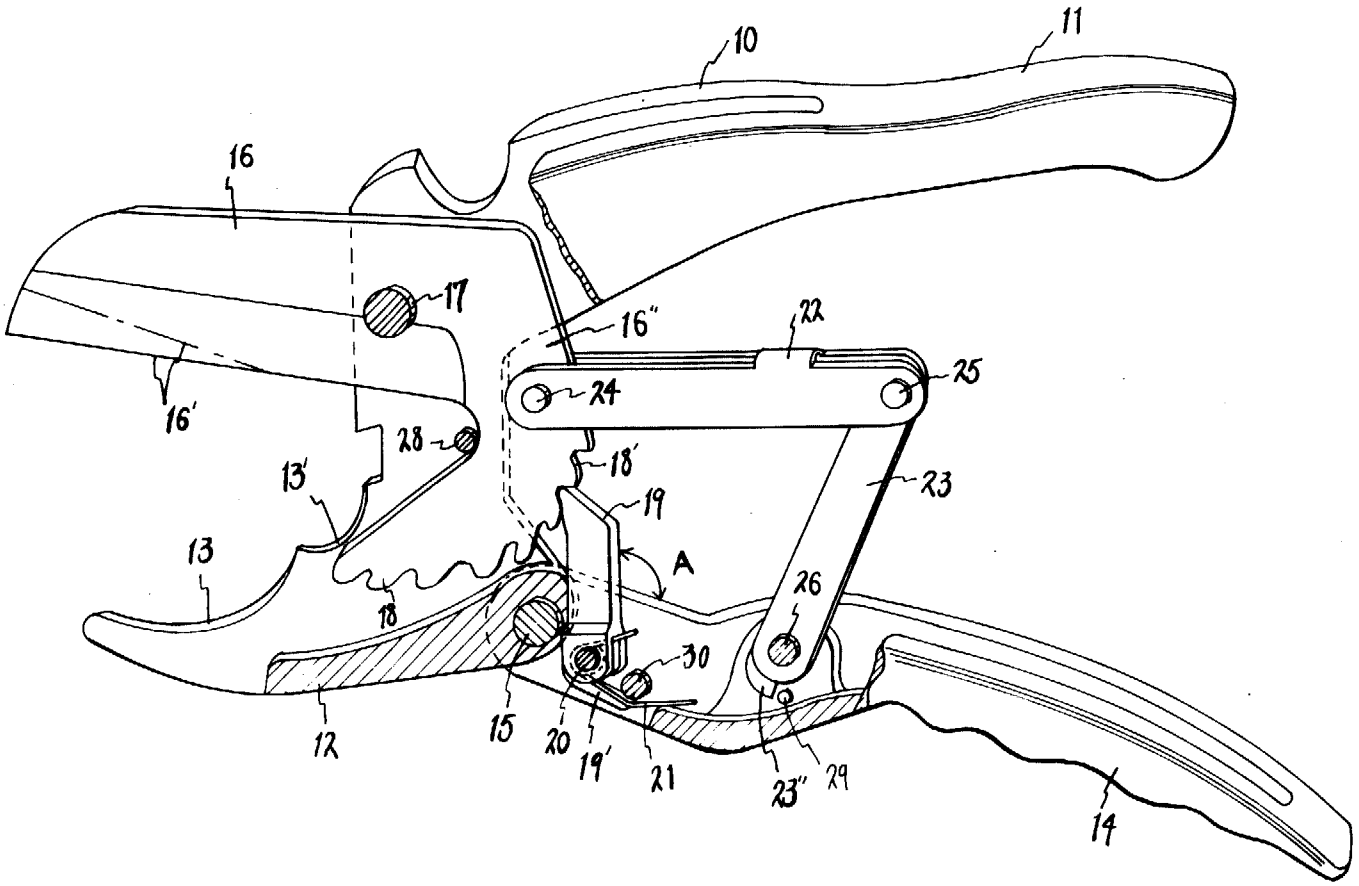
FIG. 5 is a perspective view partly broken away and showing another cutter embodying the invention.

Another embodiment described below is an improvement over the foregoing embodiment. FIG. 5 shows a spring 21 on the pivot 20 biasing the pawl 19 into engagement with the ratchet tooth 18 at all times. The spring 21 has one end in engagement with the operating handle 14, acting to increase the angle A between the pawl 19 and the operating handle 14 and urging the operating handle 14 away from the holder handle 11 at all times. With this arrangement, the spring 27 shown in FIG. 2 can be dispensed with. The holder portion 12 of the main body 10 is formed in its upper edge with circular arc recesses 13 and 13' continuous with each other but having different radii. The recessed portion 13 is adapted for holding large-diameter pipes, and the recessed portion 13' provided for holding small-diameter pipes. Workpieces of either diameter can be held by the recessed portion 13 or 13' so as to be cuttable free of any displacement to give a smooth cut end which is perpendicular to the axis of the workpiece. Especially when cutting pipes of small diameter, the curved edge of the recessed portion 13' intimately fits around and supports the pipe, permitting the cutting edge 16' to bite into the pipe without deforming the pipe to an elliptical form in section or cracking the pipe in the vicinity of the cutting portion owing to a lateral force exerted thereon.

The link 23 shown in FIG. 5 has a projection 23" projecting from its lower end and engageable by a pin 29 on the operating handle 14, whereby the link 23 is restrained from turning. The operating handle 14, when opened relative to the handle 11, causes the links 22 and 23 to move the cutting blade 16 away from the recessed portions 13 and 13'. After the link 23 has been prevented from turning by the pin 29 during this movement, further opening of the operating handle 14 causes the links 22 and 23 to turn the cutting blade 16 clockwise about the pin 17. This arrangement is advantageous over that shown in FIG. 2 in that the links 22 and 23 will not interfere with the handles 11 and 14 when they are brought close to each other. The link 23 need not be provided with the slot 23' formed in the foregoing embodiment, therefore.

As illustrated, the toothed portion 18 includes teeth of smaller pitch in its forward half for the initiation of cutting operation, such that the cutting edge 16' will bite into the workpiece more slowly in the initial stage of cutting than in the subsequent stage, in which teeth of large pitch will effect a rapid cutting operation. The pawl 19 is formed at its lower end with a projection 19' which is engageable by a pin 30 on the operating handle 14 upon disengagement of the pawl 19 from the ratchet tooth 18 to limit the turn of the pawl 19.

As indicated in a dot-and-dash line in FIGS. 2 and 5, the edge 16' of the cutting blade 16 may be in a bent form having an obtuse angle, in which case the cutting edge 16' will bite into the workpiece first at the obtuse portion and therefore with greater ease when cutting the workpiece.

Figure 6:
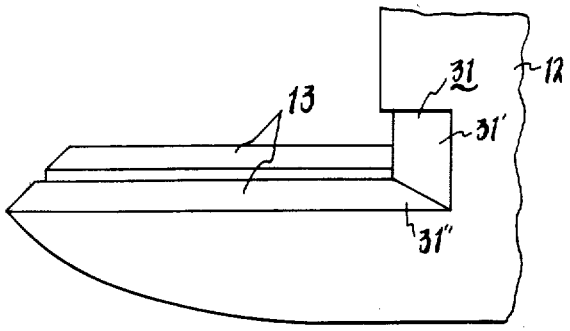
FIGS. 6 and 7 are fragmentary perspective views showing modified constructions of a principal part of the cutter of this invention.

FIG. 6 shows another embodiment in which the holder portion 12 has at its forward end a planar upper face 13 in place of the circular arc recess 13 or 13' in the foregoing embodiments. The holder portion 12 is further formed in its front edge with a slanting groove 31 defined by a sloping face 31' sloping at a specified angle (usually 45°) with respect to the clearance in the planar face 13 (namely to the cutting blade 16) and by a lower face 31" flush with the planar face 13.

Figure 10:
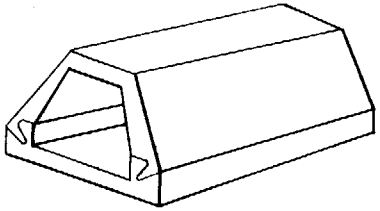
FIG. 10 is a perspective view showing a protector for telephone cables as a workpiece.

The embodiment of FIG. 6, which is adapted to support workpieces on the planar face 13, is therefore useful for tubes of polygonal section (such as a protector for telephone cables as shown in FIG. 10), bars of square to rectangular section, plates, etc. which are not reliably holdable by the recessed portion 13 or 13' in the above embodiments. Such workpieces can be supported on the planar face 13 with one side thereof in intimate contact therewith.

It is also possible to place a workpiece on the planar face 13 in an oblique position, namely at a desired angle with respect to the cutting blade 16 and to cut the workpiece obliquely with ease and accuracy. For this mode of cutting operation, the workpiece is cut on the planar face 13 with its one side held in intimate contact with the sloping face 31' defining the slanting groove 31, whereby the workpiece can be cut easily accurately free of displacement, at an angle corresponding to the angle of slope of the face 31'.

Figure 7:
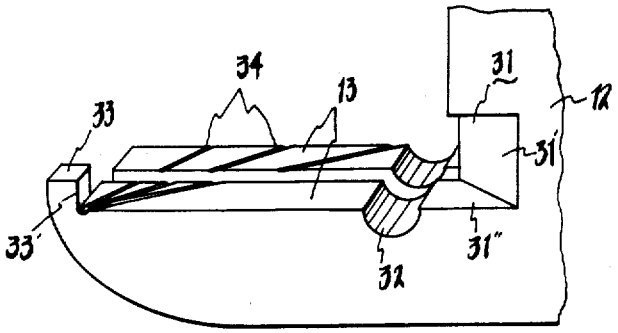

According to the embodiment of FIG. 7, the holder portion 12 has a planar face 13 formed with a groove 32 of semicircular cross section and a projection 33 projecting upward from its front edge slightly above the planar face 13. A plurality of narrow grooves 34 extend from an edge 33' of the projection as arranged at predetermined angular spacing about the edge. In addition to the advantages afforded by the planar face 13 and the slanting groove 31 of the embodiment of FIG. 6, the embodiment of FIG. 7 is adapted to reliably hold a pipe or rod of small diameter as fitted in the groove 32 of semicircular cross section and to cut such a workpiece free of any displacement without deforming, cracking or otherwise damaging the cutting portion of the workpiece. Accordingly copper tubes, wood rods, etc. as well as synthetic resin articles are reliably cuttable as held in the groove 32. Moreover, the projection 33 prevents forward displacement or dropping of the workpiece placed on the planar face 13.

When a workpiece is to be cut obliquely, the workpiece is placed on the planar face 13 with its one side in contact with the projection 33 and in alignment with one of the narrow grooves 34 and is then cut, whereby the workpiece can be cut with ease and accuracy at an angle corresponding to the angle of inclination of that groove.

Figure 8:
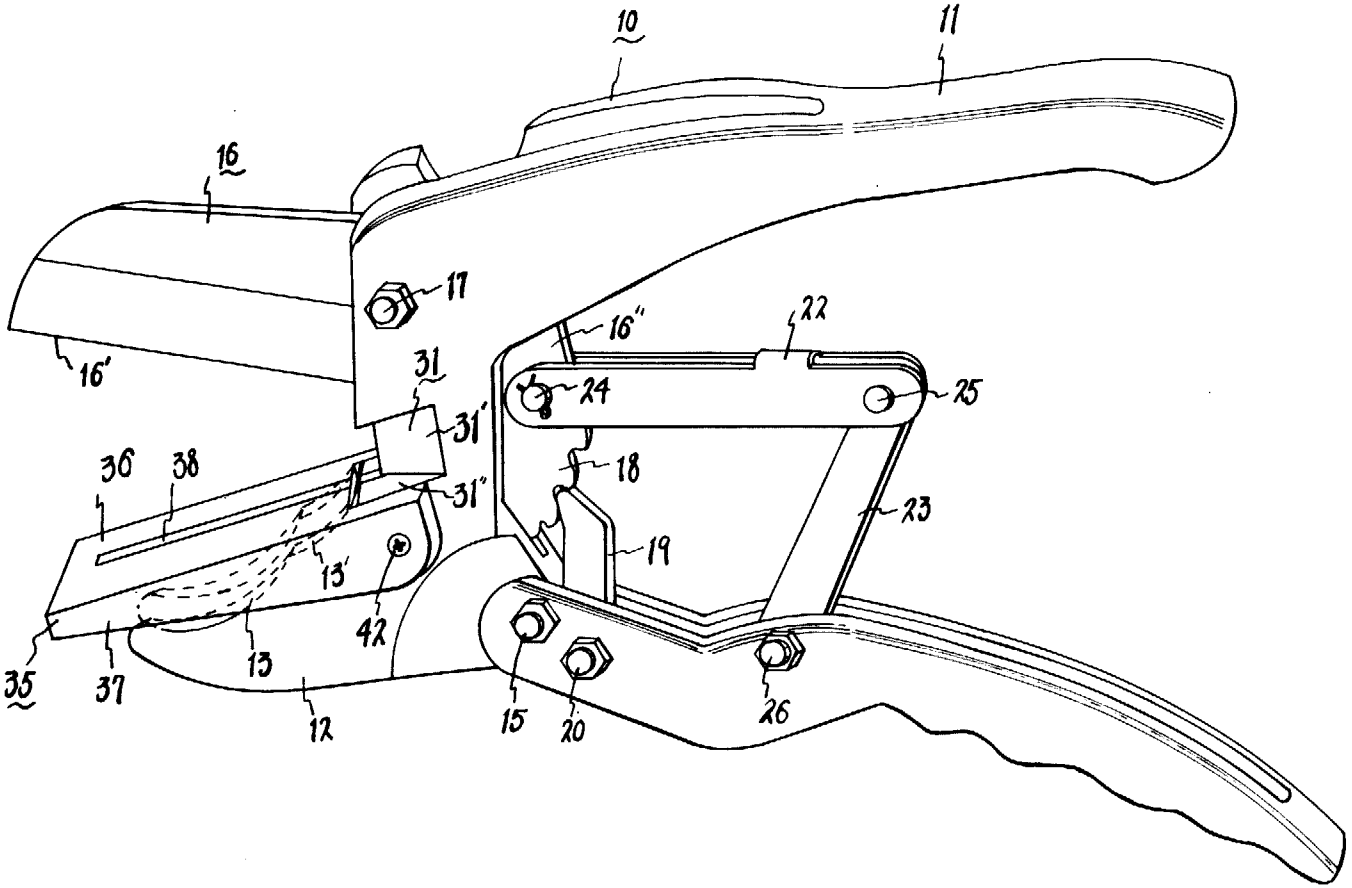
FIG. 8 is a perspective view showing another cutter of this invention including an attachment.
Figure 11:
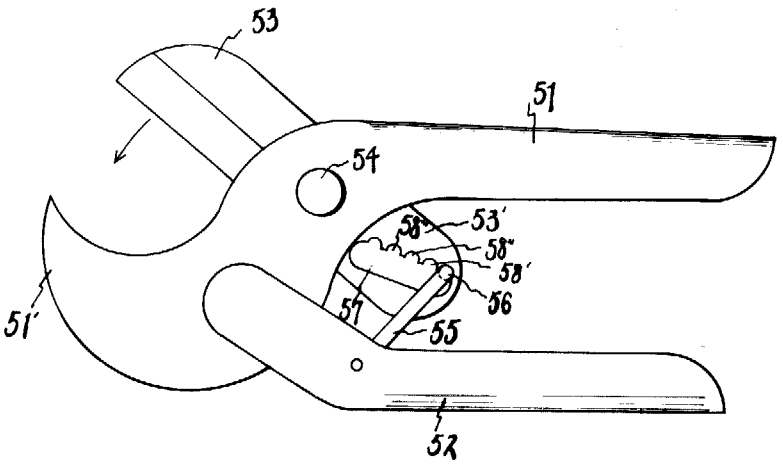
FIG. 11 is a front view showing a conventional cutter.

FIG. 8 shows another embodiment consisting basically of the embodiment of FIG. 5 and provided with an attachment 35 detachably mounted on the front of the holder portion 12 of the main body 10, namely over the recesses 13 and 13' already described. The attachment comprises an upper plate 36 having a planar top face and formed with a cutout groove 38 into which the cutting blade 16 is movable and side plates 37. The rear end (i.e. right end in FIG. 8) of the upper plate 36 is cut out, with the opposite side plates 37 extending rearward. The rear extensions of the side plates 37 fitting to the holder 12 from the front are detachably fastened thereto bu screws 42. The upper plate 36 of the attachment 35 is supported at its front end on the front end of the recessed portion 13 for supporting workpieces. The lower face 31'' defining the slanting groove 31 in the holder portion 12 is adapted to be flush with the top face of the upper plate 36 of the attachment 35 mounted on the holder portion 12.

Figure 9:
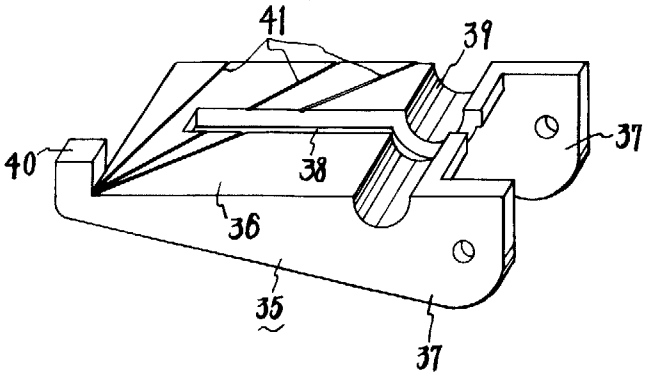
FIG. 9 is a perspective view showing a modified construction of the attachment.

FIG. 9 shows another embodiment in which the upper plate 36 of the foregoing attachment 35 is provided with a groove 39, projection 40 and narrow grooves 41 similar to the groove 32, projection 33 and narrow groove 34 of the embodiment of FIG. 6.

Thus the embodiment of FIG. 8 or 9 comprises the main body 10 of the embodiment of FIG. 2 or 5 and an attachment 35 detachably mountable on the main body and having the construction shown in FIG. 8 or 9 and therefore has increased usefulness. The embodiment of FIG. 8 or 9 has the advantages and features of the embodiment of FIG. 2 or 5 when used without the attachment 35. With the embodiment of FIG. 8 including the attachment 35, the upper plate 36 functions in the same manner as the planar face 13 of the embodiment of FIG. 6. With the embodiment of FIG. 9 having the attachment 35 mounted on the main body 10, the upper plate 36, groove 39, projection 40 and narrow grooves 41 provide the same advantages as afforded by the planar face 13, groove 32, projection 33 and narrow grooves 34 of the embodiment of FIG. 7. Thus the use of the attachment 35 of simple construction which is mountable and detachable with ease renders the cutter useful for an extremely wide range of applications.

Briefly, the cutter of this invention comprises a basic construction in which the opening and closing movement of a holder handle and an operating handle is converted through a ratchet mechanism to the turn of a cutting blade about a support pin, this construction being in combination with at least one recessed portion or an attachment. In spite of such a simple arrangement, the cutter has the outstanding advantages and features described above with reference to the preferred embodiments.

What is claimed is:

1. A cutter mainly for cutting synthetic resin articles comprising a main body including a base portion serving as a holder handle and a front half portion serving as a holder portion for holding a workpiece, an operating handle mounted by a pivot on the holder portion and movable toward and away from the holder handle in opposed relation thereto, a cutting blade turnably mounted by a support pin on the holder portion and having a cutting edge in opposed relation to the holder portion for holding the workpiece the cutting blade being formed with ratchet teeth on one side of the support pin opposed to the cutting edge, a pawl pivotally mounted by a pivot pin on the operating handle and engageable with one of the ratchet teeth to provide a ratchet mechanism, and a spring having one end secured to the operating handle and the other end attached to the base end of the pawl for biasing the pawl into engagement with the ratchet toothed portion at all times, said cutter further comprising a first link having one end pivoted to the cutting blade at a position slightly above the ratchet teeth portion thereof and the other end to a second link at one end of said second link; the other end of the second link being pivoted to the base portion of the operating handle, said links moving freely with respect to each other to permit the cutter handles to be opened and closed without interference, said links operating to return the cutter blade from the workpiece after completion of the cutting operation by opening the operating handle.

2. A cutter as defined in claim 1 wherein the first link has a fixed pin by which it is pivoted to the second link through a slot located at the end of the second link, said fixed pin being slidably fitted into the slot so that the fixed pin can freely move along the length of the slot with the opening and closing of the handles, thereby avoiding any interference with the closing of the cutter handles.

3. A cutter as defined in claim 1 whereby the holder portion has at least one recess for holding the workpiece.

4. A cutter as defined in claim 1 wherein the ratchet teeth are arranged along a circular arc centered about the support pin.

5. A cutter as defined in claim 1 wherein a spring is wound around the pivot and has one end engaging the holder portion at a specified position and the other end bearing on the operating handle to bias the operating handle away from the holder handle.

6. A cutter as defined in claim 1 wherein the spring is wound around the pivot pin and has one end engaging the operating handle and the other end engaging the pawl to bias the pawl into pressing engagement with the ratchet toothed portion at all times.

7. A cutter as defined in claim 4 wherein the ratchet teeth in the forward half of the toothed portion have a smaller pitch than the other teeth.

8. A cutter as defined in claim 1 wherein the second link has at its lower end a projection, and the operating handle is provided with a pin serving as a stopper for the projection.

9. A cutter as defined in claim 1 wherein the holder portion has a planar face in place of the recess.

10. A cutter as defined in claim 1 wherein the main body is provided with an attachment detachably mounted on the holder portion and including an upper plate having a planar top face, the upper plate being formed with a cutout groove for receiving the cutter blade therein.

11. A cutter as defined in claim 1 wherein the cutting edge of the cutting blade is inclined in relationship to its supporting pin at an obtuse angle when seen in front view so that the cutting blade bites into the workpiece at an obtuse angle to facilitate the cutting operation.

12. A cutter as defined in claim 1 wherein the holder portion has a pin serving as a stopper for the cutting blade.

13. A cutter as defined in claim 9 wherein the holder portion has a projection projecting from the forward end of the planar face slightly above the planar face, the planar face being formed with a groove of semicircular cross section and a plurality of narrow grooves extending from a specified point and arranged at predetermined angular spacing about the point.

14. A cutter as defined in claim 9 wherein the holder portion is formed at the juncture between the holder portion and the holder handle with a slanting groove defined by a lower face flush with the top face of the upper plate and a sloping face sloping at a specified angle with respect to the cutting blade.

15. A cutter as defined in claim 10 wherein the attachment has a projection projecting upward from its forward end slightly above the upper plate, the upper plate being formed with a groove of semicircular cross section and a plurality of narrow grooves extending from a specified point and arranged at predetermined angular spacing about the point.

16. A cutter as defined in claim 10 wherein the holder portion is formed at the juncture between the holder portion and the holder handle with a slanting groove defined by a lower face flush with the top face of the upper plate and a sloping face sloping at a specified angle with respect to the cutting blade.

17. A cutter as defined in claim 13 wherein the point from which the narrow grooves extend is positioned at the outer end of the junction between the projection and the planar face.

* * * * *